US007153627B2

(12) United States Patent
Watanabe et al.

(10) Patent No.: US 7,153,627 B2
(45) Date of Patent: Dec. 26, 2006

(54) HEAT-SENSITIVE LITHOGRAPHIC PRINTING PLATE AND IMAGE FORMING METHOD

(75) Inventors: Yasuyuki Watanabe, Chiba (JP); Naohito Saito, Sakura (JP); Hisatomo Yonehara, Sakura (JP); Yasuyuki Suzuki, Kamagaya (JP)

(73) Assignee: Dainippon Ink and Chemicals, Inc., Tokyo (JP)

( * ) Notice: Subject to any disclaimer, the term of this patent is extended or adjusted under 35 U.S.C. 154(b) by 15 days.

(21) Appl. No.: 10/660,761

(22) Filed: Sep. 12, 2003

(65) Prior Publication Data

US 2004/0053165 A1 Mar. 18, 2004

(30) Foreign Application Priority Data

Sep. 17, 2002 (JP) ..... 2002-270063

(51) Int. Cl.
*G03F 7/004* (2006.01)
*G03F 7/20* (2006.01)
*G03F 7/26* (2006.01)

(52) U.S. Cl. ..... 430/270.1; 430/281.1; 430/286.1; 430/287.1; 430/288.1; 430/302; 430/309; 430/434; 430/435; 430/494; 430/944; 430/945

(58) Field of Classification Search ..... 430/270.1, 430/281.1, 286.1, 287.1, 288.1, 302, 309, 430/434, 435, 494, 944, 945
See application file for complete search history.

(56) References Cited

U.S. PATENT DOCUMENTS 5,278,126 A * 1/1994 Katano et al. ..... 503/201
5,328,797 A * 7/1994 Neubauer et al. ..... 430/169
6,218,073 B1 4/2001 Shimizu et al. ..... 430/273.1

(Continued)

FOREIGN PATENT DOCUMENTS

EP 0 945 281 A2 9/1999

(Continued)

OTHER PUBLICATIONS

Patent Application Publication No. US 2002/0001773 A1, Pub. Date on Jan. 3, 2002, Saito et al.

(Continued)

*Primary Examiner*—Amanda Walke
(74) *Attorney, Agent, or Firm*—Armstrong, Kratz, Quintos, Hanson & Brooks, LLP

(57) ABSTRACT

A negative-working CTP plate which is superior in resolution and printing resistance of the image area of a press plate is provided, which is obtained by forming a latent image on a heat-sensitive layer in a heat-sensitive lithographic printing plate comprising a substrate having a hydrophilic surface and a heat-sensitive layer made of an alkali-soluble polymer formed on the surface of the substrate, using heat generated upon irradiation with laser light, and developing the heat-sensitive layer using an alkaline developing solution. In the heat-sensitive lithographic printing plate comprising a substrate having a hydrophilic surface, and a heat-sensitive layer made of an alkali-soluble polymer formed on the surface of the substrate, an advancing contact angle ($\theta^{f1}$) of the surface of the heat-sensitive layer with water at 25° C. is within a range from 70° to 110°, a receding contact angle ($\theta^{b2}$) of the surface of the heat-sensitive layer with water at 25° C. after heating at 150° C. for 3 minutes is larger than a receding contact angle ($\theta^{b1}$) of the surface of the heat-sensitive layer with water at 25° C. before heating, and a difference in receding contact angle before and after heating, ($\theta^{b2}-\theta^{b1}$), is larger than 1° and is smaller than 40°.

8 Claims, 3 Drawing Sheets

▼ EXAMPLE USING A POLYMER HAVING Tg OF 125° C
● EXAMPLE USING A POLYMER HAVING Tg OF 82° C

U.S. PATENT DOCUMENTS

| | | | | |
|---|---|---|---|---|
| 6,245,477 | B1 | 6/2001 | Ray et al. | 430/138 |
| 6,387,588 | B1 | 5/2002 | Katano et al. | 430/270.1 |
| 6,503,685 | B1 | 1/2003 | Shimizu et al. | 430/270.1 |
| 6,509,133 | B1 | 1/2003 | Watanabe et al. | 430/270.1 |
| 6,902,863 | B1 * | 6/2005 | Serikawa et al. | 430/281.1 |

FOREIGN PATENT DOCUMENTS

| | | | |
|---|---|---|---|
| EP | 1 038 667 | A2 | 9/2000 |
| EP | 1 157 829 | A1 | 11/2001 |
| JP | 58-162389 | | 9/1983 |
| JP | 9-127683 | | 5/1997 |
| JP | 9-171249 | | 6/1997 |
| JP | 11-268225 | | 10/1999 |
| JP | 11-268413 | | 10/1999 |
| JP | 11-348446 | | 12/1999 |
| JP | 2000-131828 | | 5/2000 |
| JP | 2000-275834 | | 10/2000 |
| JP | 2000-338653 | | 12/2000 |
| JP | 2000-338654 | | 12/2000 |
| JP | 2001-330946 | | 11/2001 |
| JP | 2003-167330 | | 6/2003 |

OTHER PUBLICATIONS

European Search Report dated Jun. 24, 2005.

* cited by examiner

HEAT-SENSITIVE LITHOGRAPHIC PRINTING PLATE AND IMAGE FORMING METHOD

BACKGROUND OF THE INVENTION

1. Field of the Invention

The invention relates to a heat-sensitive lithographic printing plate used in the field of offset printing and, more particularly, to a negative-working heat-sensitive lithographic printing plate for computer-to-plate (CTP), capable of directly making plate based on a digital signal from a computer.

Priority is claimed on Japanese Patent Application No. 2002-270063, filed Sep. 17, 2003, the content of which is incorporated herein by reference.

2. Description of Related Art

Presensitized plates (PS plates) have been used as lithographic printing plate in the offset printing field for a long time. A PS plate comprises a substrate having the surface subjected to a hydrophilization treatment and a heat-sensitive resin layer formed on the substrate, and an image is formed by photolithography comprising the steps of exposing via a silver mask film and developing.

With the progress in computer image processing techniques and laser techniques, there has recently been proposed a computer-to-plate (CTP) system of digitizing image formation and irradiating with laser light based on the digitized image information to form an image directly on a photosensitive layer or a heat-sensitive layer of a lithographic printing plate, and thus an intense interest has been shown in the computer-to-plate system.

The lithographic printing plate used in the CTP system (this type of plate hereinafter abbreviated as a "CTP plate") can be divided roughly into photosensitive CTP plates using a silver or a highly sensitive photopolymer photosensitive material, which is sensitive to visible light or ultraviolet light, and heat-sensitive CTP plate using a photosensitive material, which is sensitive to heat generated by absorbing near infrared light or infrared light, in the presence of an infrared absorber. In the case of the photosensitive CTP plate, a low power laser can be used because of its high sensitivity; however it requires an operation in a dark room and is insufficient in handlability and operability. On the other hand, although the heat-sensitive CTP plate has lower sensitivity than that of the photosensitive CTP plate, it has rapidly spread for the following reasons. That is, a small-sized high-power near infrared laser has recently been developed and the heat-sensitive CTP plate is excellent in operability in a lighted place such as lighted room because it is not sensitive to visible light and ultraviolet light and, furthermore, it has high resolution.

In particular, the development of the negative-working CTP plate has advanced because the area of the image area to be irradiated with a laser may be smaller than that in the case of the positive-working CTP plate. However, in a conventional negative-working CTP plate, the image area must be preheated after irradiation with a laser.

As the negative-working CTP plate which does not require the preheating process, there is proposed a heat-sensitive CTP plate comprising a substrate and a heat-sensitive layer containing water-soluble ammonium salt or amine salt, which is obtained by reacting a water-insoluble resin having a carboxyl group with ammonia or amine, and a photothermal conversion material, which absorbs light and converts light into heat, as an active component, formed on the substrate (see, for example, Japanese Unexamined Patent Application, First Publication No. Sho 58-162389). Regarding the heat-sensitive layer of the heat-sensitive CTP plate, the portion exposed to the laser is heated and, therefore, the ammonium salt or amine salt at the heated portion is decomposed and ammonia or amine is released and volatilized. As a result, the exposed portion is insolubilized. However, a press plate obtained by developing the heat-sensitive layer thus obtained had a problem in that satisfactory printing resistance cannot be obtained because the image area has low water resistance.

There is also proposed a heat-sensitive CTP plate comprising a substrate and a heat-sensitive layer containing fine particles made of a self water-dispersible thermoplastic resin and an infrared absorber (hereinafter abbreviated as an "IR absorber") as an active component formed on the substrate (see, for example, Japanese Unexamined Patent Application, First Publication No. Hei 9-127683). In the case of the heat-sensitive layer of the heat-sensitive CTP plate, optical energy is converted into heat by the IR absorber in the portion exposed to laser light and fine thermoplastic resin particles are fused by heat to form a latent image. Since the solubility of the latent image made of fused fine thermoplastic resin particles in an alkaline developing solution is lowered, a press plate can be obtained only by washing out the heat-sensitive layer at the unexposed portion of the heat-sensitive CTP plate after exposure to a laser using an alkaline developing solution. However, the CTP plate has a problem in that fine particles at the exposed portion are completely fused with difficulty and cracking originating in the unfused portion occurs during printing and, therefore, satisfactory printing resistance cannot be obtained.

There is also proposed a heat-sensitive CTP plate comprising a substrate and a heat-sensitive layer containing a hydrophilic binder and fine hydrophobic resin particles dispersed in the hydrophilic binder as a main component formed on the substrate (see, for example, Japanese Unexamined Patent Application, First Publication No. Hei 9-171249 and Japanese Unexamined Patent Application, First Publication No. Hei 11-268225). However, the heat-sensitive CTP plate has a problem in that a press plate obtained by exposing it to a laser and developing is insufficient in water resistance of the image area and image defects occur during printing for a long time using dampening water and, therefore, satisfactory printing resistance cannot be obtained.

BRIEF SUMMARY OF THE INVENTION

An object to be achieved by the present invention is to provide a negative-working CTP plate with superior resolution and printing resistance of the image area of a press plate, which is obtained by forming a latent image on a heat-sensitive layer in a heat-sensitive lithographic printing plate comprising a substrate having a hydrophilic surface and a heat-sensitive layer made of an alkali-soluble polymer formed on the surface of the substrate, using heat generated upon irradiation with laser light, and developing the heat-sensitive layer using an alkaline developing solution.

The present inventors have found that a heat-sensitive CTP plate having excellent resolution and printing resistance can be obtained by using an alkali-soluble polymer excellent in balance between hydrophilicity and hydrophobicity as a heat-sensitive layer in the heat-sensitive lithographic printing plate, and that balance between hydrophilicity and hydrophobicity of the alkali-soluble polymer can be judged by a contact angle of the surface of the heat-sensitive layer with water. Thus, the present invention has been completed.

To achieve the object described above, the present invention provides a heat-sensitive lithographic printing plate comprising a substrate having a hydrophilic surface, and a heat-sensitive layer made of an alkali-soluble polymer formed on the surface of the substrate, wherein an advancing contact angle ($\theta^{f1}$) of the surface of the heat-sensitive layer with water at 25° C. is within a range from 70° to 110°, a receding contact angle ($\theta^{b2}$) of the surface of the heat-sensitive layer with water at 25° C. after heating at 150° C. for 3 minutes is larger than a receding contact angle ($\theta^{b1}$) of the surface of the heat-sensitive layer with water at 25° C. before heating, and a difference in receding contact angle before and after heating, ($\theta^{b2}-\theta^{b1}$), is larger than 1° and is smaller than 40°.

To achieve the object described above, the present invention also provides an image forming method, which comprises forming a latent image on a heat-sensitive layer of the heat-sensitive lithographic printing plate using heat generated upon irradiation with laser light, and developing the heat-sensitive layer using an alkaline developing solution of pH 9 to 14.

In the heat-sensitive lithographic printing plate of the present invention, since an advancing contact angle ($\theta^{f1}$) of the surface of the heat-sensitive layer with water at 25° C. is within a range from 70° to 110°, a receding contact angle ($\theta^{b2}$) of the surface of the heat-sensitive layer with water at 25° C. after heating at 150° C. for 3 minutes is larger than a receding contact angle ($\theta^{b1}$) of the surface of the heat-sensitive layer with water at 25° C. before heating, and a difference in receding contact angle before and after heating, ($\theta^{b2}-\theta^{b1}$), is larger than 1° and is smaller than 40°, the image area of the press plate, which is obtained by forming a latent image on a heat-sensitive layer using heat generated upon irradiation with laser light, and developing the heat-sensitive layer using an alkaline developing solution is superior in resolution and printing resistance.

Also, the heat-sensitive lithographic printing plate of the present invention, in which a copolymer of a monomer having a carboxyl group and a hydrophobic monomer is used as an alkali-soluble polymer used in the heat-sensitive layer, is particularly superior in resolution and printing resistance.

Furthermore, the heat-sensitive lithographic printing plate of the present invention, in which a copolymer of acrylic acid or methacrylic acid and a hydrophobic monomer selected from styrene, styrene derivatives and methyl methacrylate is used as an alkali-soluble polymer used in the heat-sensitive layer, is excellent in storage stability under high humidity.

According to the heat-sensitive lithographic printing plate of the present invention, it is made possible to obtain a press plate having excellent resolution and printing resistance by forming a latent image on a heat-sensitive layer using heat generated upon irradiation with laser light, and developing the heat-sensitive layer using an alkaline developing solution of pH 9 to 14.

DETAILED DESCRIPTION OF THE INVENTION

Figure 1:
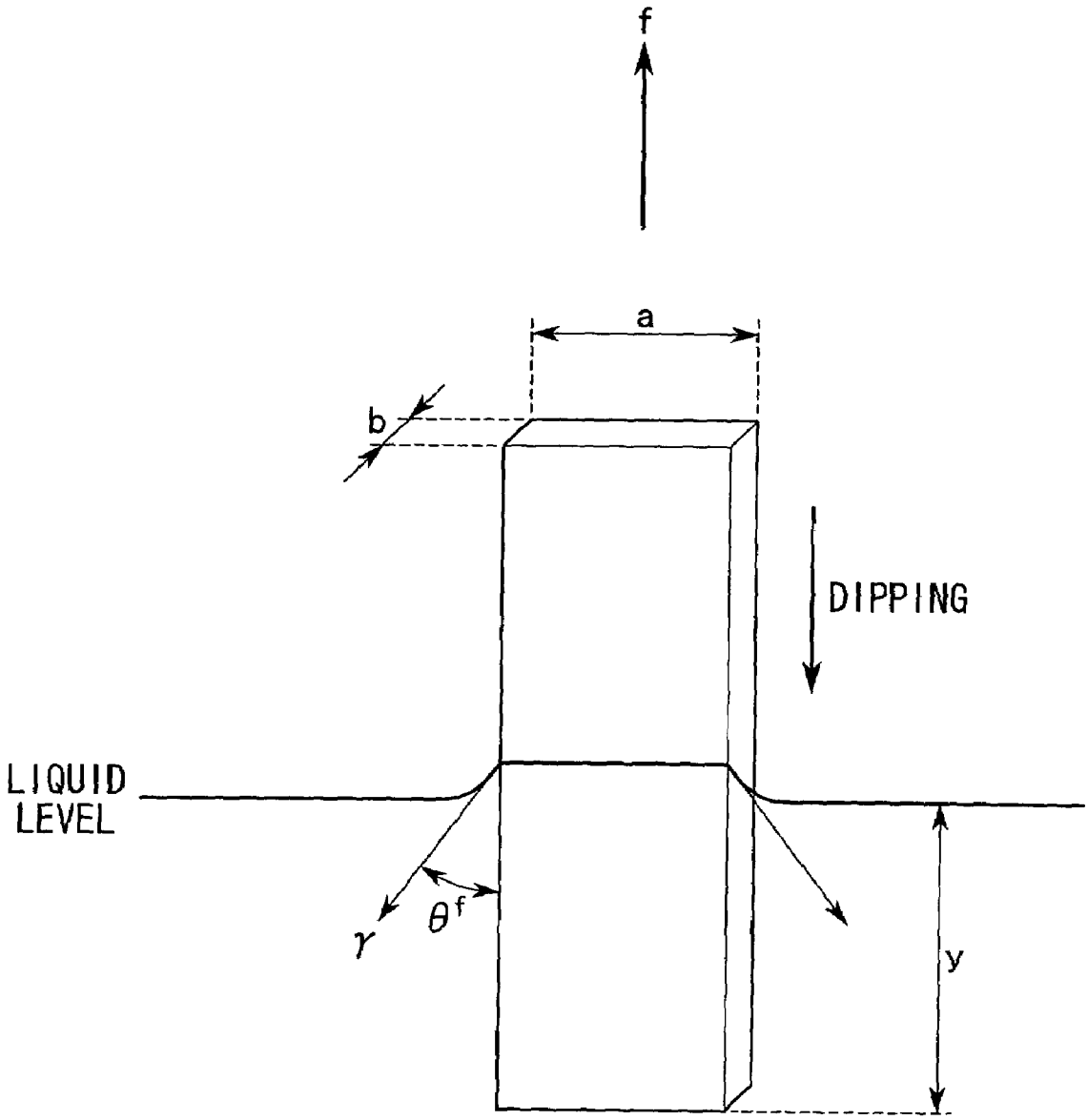
FIG. 1 is a schematic view showing a principle for the measurement of an advancing contact angle using the Wilhelmy plate method.

The alkali-soluble polymer used in the present invention (hereinafter abbreviated as the "polymer used in the present invention") refers to a polymer which has an acidic group such as a carboxyl group and is soluble in an aqueous alkaline solution.

The polymer used in the present invention is preferably designed so that water serves as a poor solvent. When using a water-soluble resin which enables water to serve as a good solvent, for example, polyacrylic acid, polyethylene glycol, or polyvinyl alcohol, the contact angle is not within a rage defined in the present invention.

The amount of the acidic group of the polymer used in present invention varies depending on the type of monomer constituting the polymer, but is preferably an amount which controls an acid value of the polymer to within a range from 40 to 500, and particularly preferably from 45 to 300.

The polymer used in the present invention is obtained by polymerizing a polymerizable composition containing a monomer having an acidic group such as a carboxyl group as a component. Examples of the monomer having an acidic group include acrylic acid, methacrylic acid, maleic acid, maleic anhydride, itaconic acid, and itaconic anhydride. When using acrylic acid or methacrylic acid among these monomers, it is easily copolymerized with the other monomer and it becomes easy to design the resin.

As described above, the polymer of the present invention is preferably a copolymer of a monomer having an acidic group and a hydrophobic monomer. Examples of the hydrophobic monomer include acrylate esters such as methyl acrylate, ethyl acrylate, and butyl acrylate; methacrylate esters such as methyl methacrylate, butyl methacrylate, and 2-ethylhexyl methacrylate; styrene derivatives such as styrene, 2-methylstyrene, 3-methylstyrene, 4-methylstyrene, 4-ethylstyrene, 2,4-dimethylstyrene, 4-n-butylstyrene, 4-tert-butylstyrene, 4-n-hexylstyrene, 4-n-octylstyrene, 4-n-nonylstyrene, 4-n-decylstyrene, 4-hydroxystyrene, 4-acetoxystyrene, 4-chlorometlhylstyrene, 4-n-dodecylstyrene, 4-methoxystyrene, 4-phenyistyrene, 4-chlorostyrene, and 3,4-dichlorostyrene; and acrylonitrile and methacrylonitrile.

When using a monomer selected from monomers having an aromatic ring and a methacrylate ester having a short alkyl chain as the hydrophobic monomers a heat-sensitive CTP plate having excellent storage stability can be obtained. Among these monomers, at least one type of a hydrophobic monomer selected from styrene, styrene derivatives and methyl methacrylate is preferably used.

The amount of the monomer having an acidic group is preferably an amount which controls an acid value of the resulting polymer within a range from 40 to 500, and particularly preferably from 45 to 300.

In the case in which the polymer used in the present invention is a copolymer of a monomer having an acidic group and a hydrophobic monomer and the amount of the acidic group in the polymer is the same, the solubility of the resulting copolymer in an aqueous alkaline solution varies depending on the type of the monomer to be used. For example, when using a monomer having high hydrophobicity such as styrene as a monomer constituting the copolymer, the alkali solubility of the resulting copolymer tends to be lowered. When using a monomer having low hydrophobicity such as methyl methacrylate as a monomer constituting the copolymer, the alkali solubility of the resulting copolymer tends to be enhanced. When the solubility of the copolymer used in the present invention in an aqueous alkaline solution is too high, an advancing contact angle ($\theta^{\Omega}$) of the surface of the heat-sensitive layer with water at 25° C. of the resulting heat-sensitive lithographic printing plate is smaller than 70° and, therefore, the image area dissolves in a developing solution and no image is obtained. When the solubility of the copolymer used in the present invention in an aqueous alkaline solution is too low, the advancing contact angle ($\theta^{\Omega}$) is greater than 110° thereby causing poor development, or it becomes impossible to develop.

Therefore, when using the monomer having high hydrophobicity as a monomer constituting the copolymer, the amount of the monomer having an acidic group is preferably increased. Also, when using the monomer having low hydrophobicity as a monomer constituting the copolymer, the amount of the monomer having an acidic group is preferably decreased.

More specifically, in a copolymer composed of two components. for example, styrene and acrylic acid as the monomer, a weight ratio of a styrene unit to an acrylic acid unit is preferably controlled within a range from 60:40 to 85:15. In a copolymer composed of two components, for example, methyl methacrylate and acrylic acid, a weight ratio of a methyl methacrylate unit to an acrylic acid unit is preferably controlled within a range from 86:14 to 95:5.

When using a copolymer composed of a polymerizable composition containing at least one type of a monomer selected from styrene, styrene derivatives and methyl methacrylate as the polymer used in the present invention, a heat-sensitive lithographic printing plate having excellent storage stability is obtained. When using a copolymer comprising 60 to 85% by weight of styrene and 40 to 15% by weight of acrylic acid or methacrylic acid. a heat-sensitive lithographic printing plate having excellent storage stability under high humidity is obtained.

The polymer used in the present invention preferably has a glass transition temperature (hereinafter abbreviated as "Tg") within a range from 40 to 150° C., more preferably from 50 to 140° C., and most preferably from 60 to 130° C. When Tg is lower than 40° C., the image area has insufficient hardness and tends to be inferior in storage stability and printing resistance. On the other hand, when Tg exceeds 150° C., a large quantity of heat is required to form an image and it is not suited for practical use when using laser light. When Tg is within a range from 60 to 150° C., and preferably from 60 to 130° C., a heat-sensitive lithographic printing plate having excellent storage stability at room temperature can be obtained.

The polymer used in the present invention preferably has a weight-average molecular weight of not less than 5,000 and not more than 200,000, and more preferably not less than 10,000 and not more than 200,000. When the weight-average molecular weight is less than 5,000, the printing resistance is lowered. On the other hand, when the weight-average molecular weight exceeds 200,000, it becomes difficult to dissolve in an aqueous alkaline solution.

In the polymerization reaction of the above-mentioned monomer, known methods such as bulk polymerization and solution polymerization methods can be employed. Among these methods, a simple solution polymerization method is preferable. The solvent to be used is preferably an organic solvent. Examples of the organic solvent include aromatic hydrocarbons such as benzene, toluene, and xylene; ketones such as acetone, methyl ethyl ketone, methyl isobutyl ketone, and cyclohexanone; esters such as ethyl acetate and butyl acetate; and alcohols such as methanol, ethanol, and isopropyl alcohol. Two or more types of these organic solvents can be used in combination.

A polymerization initiator used in the solution polymerization is preferably a known radical polymerization initiator and examples thereof include azo-based polymerization initiators such as 2,2'-azobisisobutyronitrile and 2,2'-azobis (2,4-dimethylvaleronitrile); and peroxide-based polymerization initiators such as benzoyl peroxide, lauryl peroxide, and tert-butylperoxy 2-ethylhexanoate.

The polymer used in the present invention is used for the formation of a heat-sensitive layer after dissolving in an aqueous alkaline solution to form a heat-sensitive composition. The polymer used in the present invention is dissolved in the aqueous alkaline solution by dissolving the polymer in the aqueous alkaline solution after optionally removing an organic solvent in the polymer. Examples of the aqueous alkaline solution include those prepared by dissolving an amine compound such as ammonia, triethylamine, or dimethylethanolamine, or an alkali compound such as hydroxide of an alkali metal (for example, sodium hydroxide or potassium hydroxide) in water. In the case of developing using ammonia or an aqueous solution of a low-molecular weight amine compound among these aqueous alkaline solutions. a heat-sensitive lithographic printing plate having excellent printing resistance is obtained. In particular, ammonia is preferably used because ammonia is easily vaporized by heat generated upon irradiation with laser light and the surface is liable to become more hydrophobic.

The concentration of the aqueous alkaline solution varies depending on the amount of the acidic group of the polymer used in the present invention and the type of the monomer constituting the polymer, but is preferably within a range from 0to 20% by weight. The amount of the polymer used in the present invention is preferably controlled so as to obtain a solution having a dry solid content of 10 to 40% by weight.

In the heat-sensitive composition used in the present invention, a latent image can be formed by using laser light when adding a substance which absorbs light to generate heat. The substance, which absorbs light to generate heat, is a substance which exhibits absorption in a range including a laser wavelength used in the formation of a latent image, and is specifically a compound having a maximum absorption wavelength ($\lambda$max) within a range from 500 nm to 3000 nm. The use of a compound having a maximum absorption wavelength ($\lambda$max) within a near infrared to far infrared range of 760 nm to 3000 nm (hereinafter abbreviated as an "IR absorber") is more preferable because a heat-sensitive lithographic printing plate can be treated in a lighted room.

Examples of the IR absorber include organic or inorganic infrared absorbers, for example, pigments and dyes such as carbon black, phthalocyanine, naphthalocyanine, and cyanine; polymethine pigments and dyes; red absorbers such as squarilium pigments; and fine particles of tin oxide doped with a copper ion complex or antimony. These absorbers may be used alone, or two or more types thereof may be used in combination. The amount of the IR absorber to be added in the heat-sensitive composition used in the present invention is controlled so that the absorbance of the heat-sensitive composition in a wavelength range of a light source used is adjusted within a range from about 0.5 to 3. Specifically, the amount is preferably within a range from 0.5 to 50% by weight, and more preferably from 1 to 30% by weight, based on the non-volatile component. When the amount is less than 0.5% by weight, an image is not formed sufficiently because less heat is generated. On the other hand, when the amount is more than 50% by weight, the heat-sensitive lithographic printing plate becomes brittle and the surface is likely to be scratched, thereby reducing the printing resistance and causing contamination of the non-image area.

In the case in which the IR absorber is soluble in water, it may be added directly to the aqueous alkaline solution of the polymer, followed by mixing. In the case in which the IR absorber is insoluble in water, a solution prepared by dissolving the IR absorber in advance in a small amount of an organic solvent may be added to the aqueous alkaline solution of the polymer, followed by mixing. Known dispersers such as an ultrasonic disperser, sand mill, bill mill, and paint conditioner can be used for the purpose of mixing.

As described above, the heat-sensitive composition used in the present invention can be obtained.

When the heat-sensitive composition used in the present invention is colored, an image formed after the development can be visually observed. Examples of the colorant include dyes such as Crystal Violet, Malachite Green, Victoria Blue, Methylene Blue, Ethyl Violet, and Rhodamine B; and pigments such as Phthalocyaninie Blue, Phthalocyanine Green, Dioxazine Violet, and Quinacridone Red. The colorant is commonly used in a content within a range from 0.1 to 10% by weight based on the non-volatile component of the heat-sensitive composition. The colorant can be added to the heat-sensitive composition in the same manner as in the case of the IR absorber.

The heat-sensitive composition used in the present invention can be applied on the surface of a substrate having a hydrophilic surface without using surfactants, thereby obtaining a satisfactory smooth coated surface. Therefore, special auxiliary agents are not required. If necessary, there can be added optionally natural and synthetic water-soluble polymers for adjustment of the viscosity; leveling agents; water-soluble organic solvents such as methanol, ethanol, isopropyl alcohol, and acetone; hydrophilic binders such as homopolymers and copolymers of acrylamide, methylolacrylamide, methylolinethacrylamide, acrylic acid, methacrylic acid, hydroxyethyl acrylate, and hydroxyethyl methacrylate, maleic anhydride/methyl vinyl ether polymer, and natural polymer Such as gelatin or polysaiccharides; completely or partially saponified polyvinyl alcohol; and various surfactants.

The heat-sensitive composition used in the present invention contains water as an essential component. The heat-sensitive layer obtained from the heat-sensitive composition is made to be insoluble in an alkaline developing solution without causing the chemical reaction by heating at 150° C. for 3 minutes. The reason is not apparent, but is assumed to be as follows. That is, a molecular chain of the polymer constitutes a loose "thread ball"-shaped fine structure with acidic groups outside in alkali aqueous medium containing water as an essential component. The fine structure is maintained even if a heat-sensitive layer is formed. However, when heat capable of causing micro-Brownian motion of the molecular chain is applied to the heat-sensitive layer, a dynamic relaxation phenomenon occurs and the "thread ball" is melted, thereby causing uniform diffusion of acidic groups localized outside. Therefore, the heat-sensitive composition is made to be insoluble in the alkaline developing solution to form an image.

Therefore, when the heat-sensitive composition does not contain water and contains only an organic solvent, the polymer is uniformly dissolved to form no fine structure and, therefore, the resulting heat-sensitive layer is insoluble in the alkaline developing solution regardless of the presence or absence of heating. The heat-sensitive composition used in the present invention may contain an organic solvent, which is compatible with water, and the content must be controlled so that the fine structure of the polymer does not disappear. Even if the heat-sensitive composition contains water, when using a large amount of a high-boiling organic solvent, water is volatilized first when the heat-sensitive composition is applied on the substrate and is then dried. As a result, the fine structure of the polymer is made to be uniform by the residual organic solvent and it becomes difficult to develop. The organic solvent, which can be used in the heat-sensitive composition used in the present invention, is preferably an organic solvent which is an organic solvent having comparatively low boiling point and hardly dissolves a resin. Examples of the solvent include low-boiling alcohols such as methanol, ethanol, isopropyl alcohol, and propanol. When using the organic solvent in the heat-sensitive composition of the present invention, the content is 40% by weight or less, and preferably 20% or less, based on the heat-sensitive composition. It is preferable to use the solvent capable of easily dissolving the polymer, for example, alcohols having comparatively high boiling point (e.g. 2-methoxy ethanol), methyl ethyl ketone and tetrahydrofuran in the content of 10% or less, and preferably 5% or less. It is necessary to select the type of the solvent and to control the amount so that the fine structure of the polymer is not broken in the heat-sensitive composition.

The heat-sensitive lithographic printing plate is obtained by preparing a heat-sensitive composition used in the present invention so that the non-volatile component is within a range from 1 to 50% by weight in the state where the polymer is dissolved in the aqueous alkaline solution, applying the heat-sensitive composition on a substrate having a hydrophilic surface so that a film thickness after drying is within a range from 0.5 to 10 μm, and drying the heat-sensitive composition.

Examples of the base material of the substrate include metal plates made of aluminum, zinc, stainless steel, and iron; plastic films made of polyethylene terephthalate (PET), polycarbonate, polyvinyl acetal or polyethylene; composite substrates such as papers coated with polymers and plastic films covered with a hydrophilic metal using a vacuum deposition or lamination method. These base materials are used as a substrate having a hydrophilic surface after forming a hydrophilic layer on the surface or subjecting to a hydrophilization treatment. Among these substrates, an aluminum plate, or a composite substrate whose plastic film surface is coated with aluminum is preferably used. In the case in which the substrate is an aluminum plate, the substrate is preferably subjected to a surface treatment such as a graining treatment or anodizing treatment for the purpose of enhancing water retention of the surface and improving adhesion with the heat-sensitive layer.

Examples of the method of coating with the heat-sensitive composition include rotary coating method using a spin coater, dip coating method, roll coating method, curtain coating method, blade coating method, air knife coating method, spray coating method, and bar coating method.

The heat-sensitive composition used in the present invention is applied on the surface of a substrate and is then dried to form a heat-sensitive layer. Examples of the drying method include a method of drying at normal temperature, a method of using a vacuum dryer, and a method of using a hot air dryer or an infrared dryer. In the case of drying with heating, the drying temperature is set to the temperature which is 130° C. or lower and is 10° C. lower than Tg of the polymer used in the present invention. The time required to drying varies depending on the drying temperature, but is preferably from 10 seconds to 10 minutes, and more preferably from 10 seconds to 5 minutes. The drying temperature can be set to the temperature which is about Tg of the polymer used in the present invention or higher. In this case, it is necessary to dry within a shorter time so that the entire or partial heat-sensitive layer is made to be insoluble in the alkaline developing solution as a result of heating.

Balance between hydrophilicity and hydrophobicity of the polymer used in the present invention can be confirmed from a contact angle of a heat-sensitive layer of a heat-sensitive lithographic printing plate using the polymer with water. In the heat-sensitive lithographic printing plate of the present invention, in the case in which an advancing contact angle ($\theta^{f1}$) of the surface of the heat-sensitive layer with water at 25° C. is within a range from 70° to 110°, a receding contact angle ($\theta^{b2}$) of the surface of the heat-sensitive layer with water at 25° C. after heating at 150° C. for 3 minutes is larger than a receding contact angle ($\theta^{b1}$) of the surface of the heat-sensitive layer with water at 25° C. before heating, and a difference in receding contact angle before and after heating, ($\theta^{b2}-\theta^{b1}$), is larger than 1° and is smaller than 40°, the heat-sensitive lithographic printing plate is excellent in storage stability and the press plate obtained from the printing plate is excellent in printing resistance.

As a method of measuring a contact angle, a method of directly measuring a contact angle of liquid adhered on the surface of a solid plate (for example, drop method or foaming method) and a method of indirectly measuring a dynamic contact angle (for example, Wilhelmy plate method) are known. As the contact angle in the present invention, a value measured by the Wilhelmy plate method is used.

Figure 2:
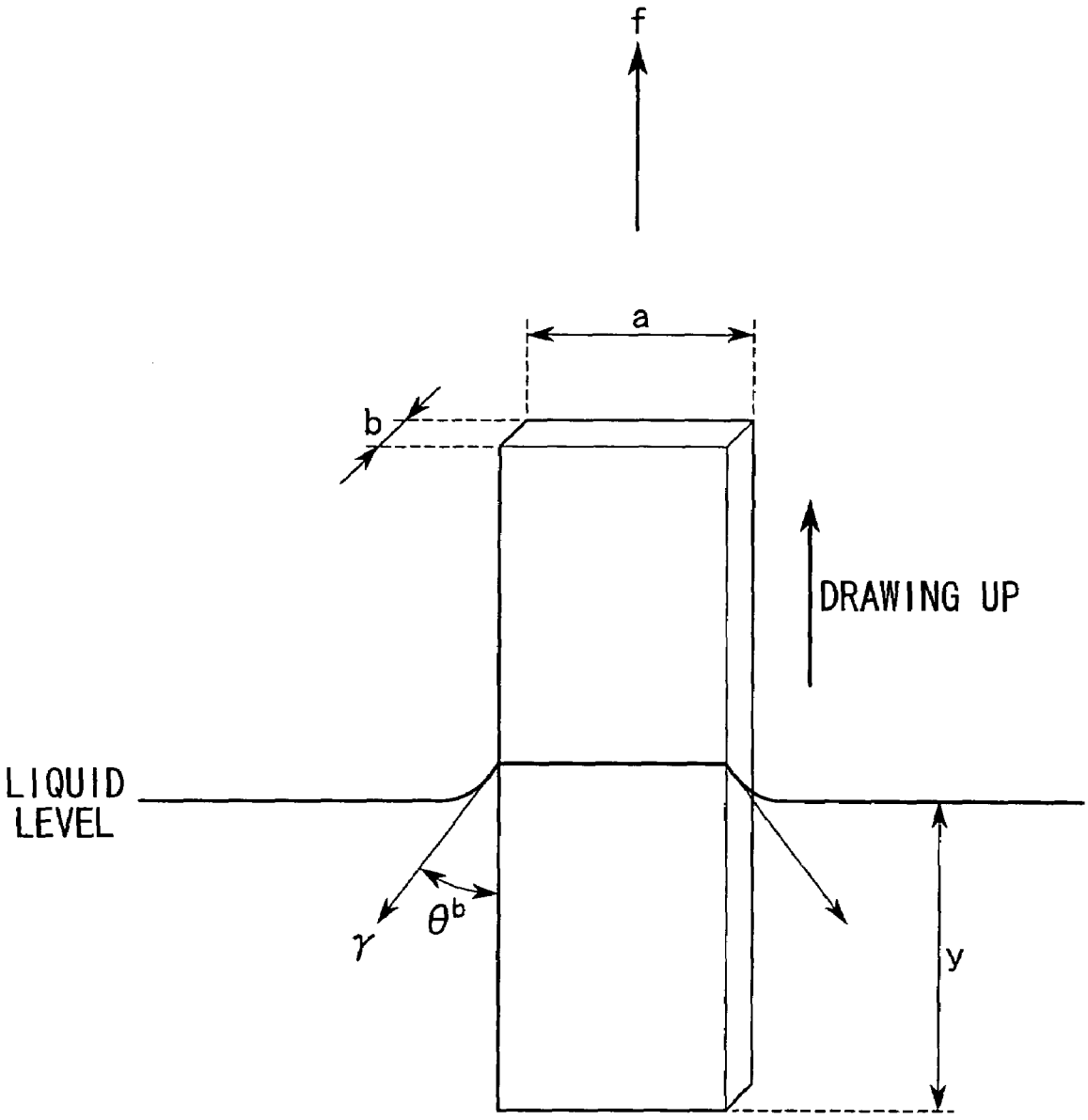
FIG. 2 is a schematic view showing a principle for the measurement of a receding contact angle using the Wilhelmy plate method.

According to the Wilhelmy plate method, as shown in FIG. 1, an advancing contact angle ($\theta^f$) can be determined from the following general formula (1) by continuously measuring an upward force (f) required to support the specimen while dipping the specimen vertically to the liquid level. Similarly, as shown in FIG. 2, a receding contact angle ($\theta^b$) can be determined from the following general formula (2) by continuously measuring an upward force (f) required to support the specimen while dipping the specimen vertically to the liquid level. According to this method, since the advancing contact angle or receding contact angle can be measured as an average value of the entire surface, it can be measured, continuously or repeatedly, with good reproducibility in an easy manner.

$$f=p\gamma\cos\theta^f-Apy+mg \quad \text{(Equation 1)}$$

$$f=p\gamma\cos\theta^b-Apy+mg \quad \text{(Equation 2)}$$

where a and b represent a long side and a short side of the surface parallel to the liquid level of the specimen, respectively, p represents a horizontal circumference corresponding to (a+b)×2, γ represents a surface tension of liquid, $\theta^f$ represents an advancing contact angle, $\theta^b$ represents a receding contact angle, A represents a cross-section portion (a×b) of the surface parallel to the liquid level of the specimen, ρ represents a density of liquid, y represents a submergence depth of the specimen, m represents a weight of the specimen, and g represents a gravitational acceleration.

The advancing contact angle and receding contact angle in the present invention are values measured at a dipping rate and a draw up rate of 6 mm/min using the specimen in size of 2 cm×2 cm. When they are measured at the above-mentioned rate, the measured values do not vary and disturbance of the liquid level does not occur and, furthermore, no noise is generated in the measured values.

In the case of measuring the advancing contact angle and receding contact angle by the Wilhelmy plate method, a heat-sensitive layer is preferably provided on all six surfaces of the specimen which are to be in contact with water. In the case of measuring the advancing contact angle and receding contact angle of the heat-sensitive lithographic printing plate of the present invention by the Wilhelmy plate method, the specimen made by the following method is used without providing the heat-sensitive layer on all six surfaces of the specimen for the following reason. In the case of the heat-sensitive lithographic printing plate provided with the heat-sensitive layer on both sides of the substrate, the specimen may be made by cutting into a predetermined size. In the case of the heat-sensitive lithographic printing plate provided with the heat-sensitive layer on one side of the substrate, the specimen may be made by cutting two heat-sensitive lithographic printing plates, each surface of the substrate opposite the surface, on which the heat-sensitive layer was provided being laminated, of the heat-sensitive lithographic printing plates being laminated with a proper adhesive, into a predetermined size.

The specimen thus made is not provided with the heat-sensitive layer on the end face, and the heat-sensitive lithographic printing plate generally has a comparatively small thickness within a range from 0.1 to 0.5 mm, and also the horizontal circumference (p) of the specimen is 400 to 2000 times larger than the thickness. Therefore, it is made possible to neglect the influence of the absence of the heat-sensitive layer oil the partial surface of the specimen.

Examples of an apparatus capable of measuring the advancing contact angle and the receding contact angle based on the above-mentioned principle include a surface tension contact angle automeasuring apparatus "K12" manufactured by Kruss Co. in Germany.

Figure 3:
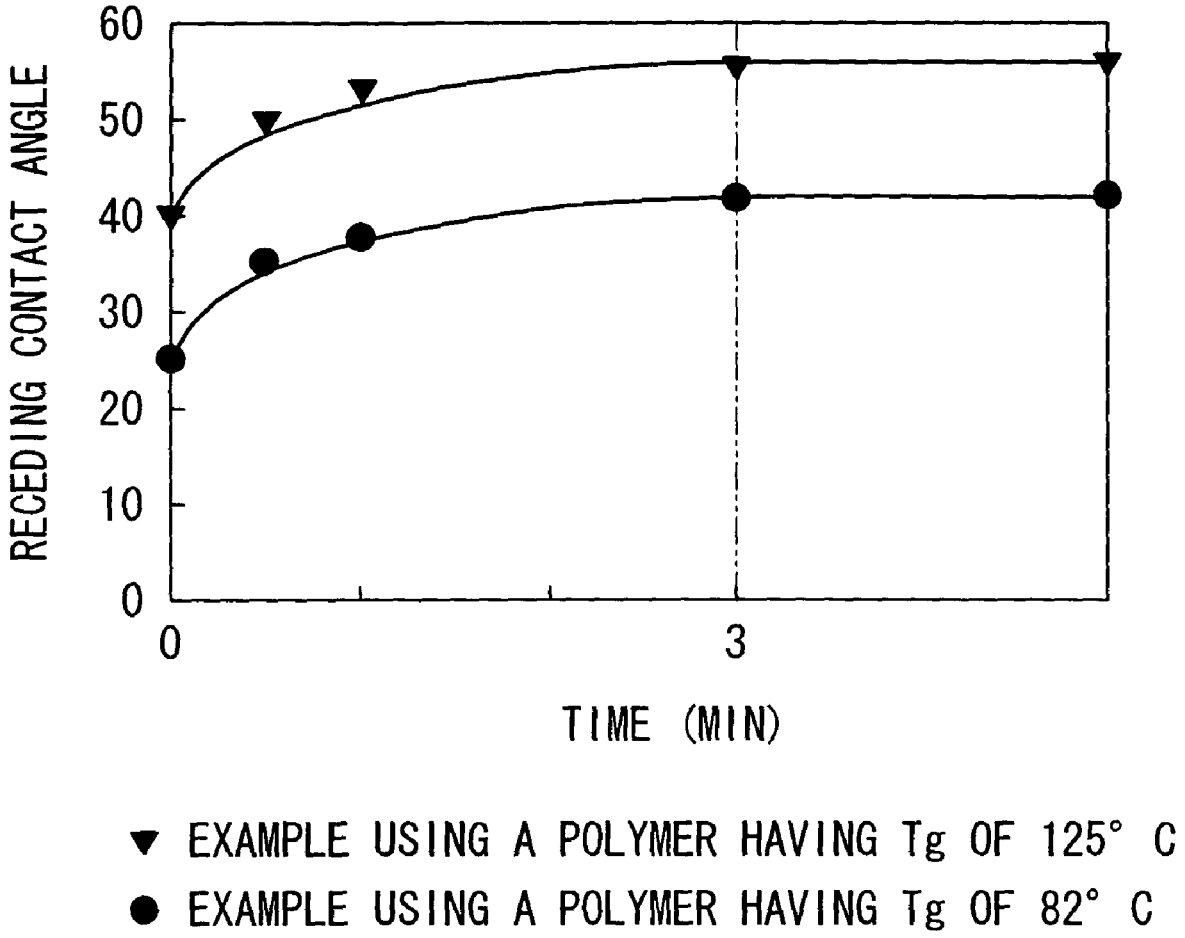
FIG. 3 is a graph showing a change in a receding contact angle over time when the surface of a heat-sensitive layer is heated to 150° C.

Examples of the method of heating the surface of the heat-sensitive layer at 150° C. for 3 minutes includes a method of allowing the heat-sensitive lithographic printing plate to stand in a hot air dryer heated to 150° C. for 3 minutes. After heating, the heat-sensitive lithographic printing plate is naturally or forcibly air-cooled. Then, the advancing contact angle and the receding contact angle are measured by the Wilhelmy plate method. FIG. 3 is a graph showing a change in a receding contact angle over time of the heat-sensitive lithographic printing plate of the present invention having a heat-sensitive layer which contains two types of alkali-soluble polymers having different Tg. As is apparent from FIG. 3, 3 minutes after heating the Surface of the heat-sensitive layer to 150° C., Tg almost does not vary.

In the heat-sensitive lithographic printing plate of the present invention, an advancing contact angle ($\theta^{f1}$) of the surface of the heat-sensitive layer with water at 25° C. meets the range from 70° to 110°, a receding contact angle ($\theta^{b2}$) of the surface of the heat-sensitive layer with water at 25° C. after heating at 150° C. for 3 minutes is larger than a receding contact angle ($\theta^{b1}$) of the surface of the heat-sensitive layer with water at 25° C. before heating, and a difference in receding contact angle before and after heating, ($\theta^{b2}-\theta^{b1}$), is larger than 1° and is smaller than 40°. When the difference in receding contact angle before and after heating ($\theta^{b2}-\theta^{b1}$) is smaller than 1°, it is impossible to develop. On the other hand, when the difference in receding contact angle before and after heating, ($\theta^{b2}-\theta^{b1}$), is larger than 40°, the heat-sensitive layer has a rough surface and poor printing resistance. It is particularly preferable that the receding contact angle ($\theta^{b1}$) be within a range from 5° to 50° and also the receding contact angle ($\theta^{b2}$) is within a range from 30° to 60°. The difference in a receding contact angle, ($\theta^{b2}-\theta^{b1}$), is preferably within a range from 10° to 30°, because of excellent printing resistance.

The heat-sensitive lithographic printing plate of the present invention, which meets the conditions of the contact angle, is excellent in printing resistance for several reasons.

To obtain a press plate using the heat-sensitive lithographic printing plate of the present invention, a latent image is formed on a heat-sensitive layer of the printing plate using heat generated upon irradiation with laser light. After the development the heated portion of the heat-sensitive layer is made to be insoluble in a developing solution to form an image area, while the other portion is removed after being dissolved in the developing solution. The latent image can also be formed by heating the heat-sensitive layer of the printing plate using a thermal head in place of heat generated upon irradiation with laser light.

The fact that the advancing contact angle ($\theta^{f1}$) of the heat-sensitive lithographic printing plate with water at 25° C. is smaller than 70° means that the heat-sensitive layer converted into the image area has high hydrophilicity or has high surface roughness. When the heat-sensitive layer has high hydrophilicity, the image area is eroded with dampening water during printing and, therefore, satisfactory printing resistance cannot be obtained. When the heat-sensitive layer has high surface roughness, a large force is periodically applied and, therefore, satisfactory printing resistance cannot be obtained The fact that the advancing contact angle ($\theta^{f1}$) of the heat-sensitive lithographic printing plate with water at 25° C. is larger than 110° means that the non-heated heat-sensitive layer has low hydrophilicity. When the heat-sensitive layer has low hydrophilicity, the development cannot be carried out, or surface contamination due to poor development is likely to occur.

When the advancing contact angle ($\theta^{f1}$) meets the range from 70° to 110°, there can be obtained a press plate wherein the heat-sensitive layer is suited for alkaline development and is excellent in balance between hydrophilicity and hydrophobicity, and also has low surface roughness. The advancing contact angle ($\theta^{f1}$) is more preferably within a range from 75 to 110°, and most preferably from 80 to 105°.

The receding contact angle ($\theta^{b}$) changes before and after heating and the receding contact angle of the heat-sensitive layer increases after heating at 150° C. for 3 minutes.

High receding contact angle ($\theta^{b}$) means that the surface has hydrophobicity. That is, the fact the receding contact angle increases by heating means that the surface of the heat-sensitive layer becomes hydrophobic. The surface of the heat-sensitive layer becomes hydrophobic for the following two reasons, for example, the heat-sensitive layer becomes more smooth, or affinity between the surface and water is lowered and the surface becomes chemically hydrophobic.

1. Reason why the Surface of the Heat-Sensitive Layer Becomes More Smooth after Heating To the polymer used in the present invention, water serves as a poor solvent. It is assumed that, when the polymer used in the present invention is dissolved in an aqueous alkaline solution, the polymer constitutes a loose "thread ball"-shaped fine structure with acidic groups outside in water. Therefore, the heat-sensitive layer obtained by applying the polymer solution on the surface of the substrate and drying the solution also maintains this fine structure. Observing using an atomic force microscope (hereinafter abbreviated as "AFM"), nano-scale unevenness in is formed on the surface of the heat-sensitive layer. It is assumed that a partial "thread ball" of the molecular chain appears on the surface to form nano-scale unevenness. Observing using AFM, unevenness on the surface of the heat-sensitive layer slightly decreased after heating the heat-sensitive layer at 150° C. for 3 minutes. This means that the partial "thread ball" of the molecular chain disappears or decreases as a result of heating. The heating temperature of 150° C. is a temperature of about Tg or higher to the polymer used in the present invention, and is also a temperature at which the molecular chain of the polymer can cause micro-Brownian motion. Therefore, it is assumed that, when heated to 150° C. for 3 minutes, the polymer in the heat-sensitive layer is relaxed and the "thread ball"-shaped molecular chain comes loose and extends and, therefore, the inner fine structure becomes uniform. It is assumed that, since the partial "thread ball"-shaped fine structure disappears, the surface of the heat-sensitive layer becomes softer, resulting in high receding contact angle.

This assumption can also be explained by the fact that a change in receding contact angle before and after heating at 150° C. for 3 minutes does not occur in the heat-sensitive layer formed by applying a composition, which is prepared by dissolving the polymer used in the present invention in an organic solvent as a good solvent, and drying the composition.

As the polymer constituting the heat-sensitive layer of the heat-sensitive lithographic printing plate of the present invention, polyacrylic acid, polyethylene glycol and polyvinyl alcohol cannot be used. The reason why these polymers cannot be used is assumed as follows. That is, since water serves as a good solvent to these polymers, the molecular chain in the heat-sensitive layer has already been uniform before heating, and no dynamic relaxation phenomenon is caused by heating.

2. Reason why the Surface of the Heat-Sensitive Layer Becomes Hydrophobic after Heating It is considered that the polymer used in the present invention constitutes a loose "thread ball"-shaped fine structure with acidic groups outside in an aqueous alkaline solution, and it is assumed that acidic groups are localized on the surface of the heat-sensitive layer obtained by applying the polymer on the surface of the substrate and drying the polymer. It is believed that, when the heat-sensitive layer is heated, acidic groups localized on the surface are delocalized in the heat-sensitive layer and, therefore, the surface becomes hydrophobic.

It is also believed that a basic compound such as ammonia, which neutralizes acidic groups, is vaporized by heating and the surface becomes hydrophobic. According to the heat-sensitive lithographic printing plate of the present invention, an image can be formed by developing after forming a latent image using heat even when using a heat-sensitive lithographic printing plate which scarcely contains the basic compound such as ammonia in the heat-sensitive layer under vacuum drying. This fact shows that vaporization of ammonia is not a direct factor for formation of the image.

It is assumed that, in the heat-sensitive lithographic printing plate of the present invention, an image is formed by a mechanism which is quite different from that of conventional vaporization of ammonia or fusion of particles.

The heat-sensitive lithographic printing plate of the present invention is preferably a heat-sensitive lithographic printing plate which exhibits fixed advancing and receding contact angles and causes no change in contact angle even if dipping and drawing up operations are repeatedly carried out by the Wilhelmy plate method.

It is possible to preferably use a heat-sensitive lithographic printing plate, in which when repeating measurement is carried out by repeating dipping and drawing up operations by the Wilhelmy plate method, the second measured values decrease as compared with the first measured values of the advancing contact angle and the receding contact angle and also the third or subsequent measured values become fixed values, as the heat-sensitive lithographic printing plate of the present invention if the decrease ratio is less than 30%. When the decrease ratio of the second or subsequent measured values exceeds 30%, the printing resistance tends to deteriorate. When the decrease ratio of the second or subsequent measured values exceeds 50%, the heat-sensitive layer itself tends to adsorb or absorb water and, therefore, it is not preferable. The heat-sensitive lithographic printing plate, in which the measured values gradually decrease by repeating measurement, tends to have high hydrophilicity and poor printing resistance.

An image can be formed by forming a latent image on a heat-sensitive layer of the heat-sensitive lithographic printing plate of the present invention using heat generated upon irradiation with laser light based on image information, and developing the layer using an alkaline developing solution of pH 9 to 14.

In particular, when using a heat-sensitive lithographic printing plate having a heat-sensitive layer containing a substance which absorbs light to generate heat, an image having high resolution can be obtained by irradiation with laser light.

Examples of the laser used to form a latent image include laser having an emission wavelength of 500 nm to 3000 nm. A heat-sensitive lithographic printing plate, which uses a laser light source having a maximum intensity within a near infrared to far infrared range from 760 nm to 3000 nm, can be treated in a lighted room. Examples of the laser include a semiconductor laser and a YAG laser. The emission wavelength of these laser devices may correspond to an absorption wavelength of the substance which absorbs light to generate heat.

After a latent image was formed on the heat-sensitive layer of the heat-sensitive lithographic printing plate of the present invention, the unheated portion is developed by removing with dissolving using an alkaline developing solution to form a press plate. The alkaline developing solution is preferably an aqueous solution of an alkali substance. Examples of the alkali substance include inorganic alkali compounds such as sodium silicate, potassium silicate, potassium hydroxide, sodium hydroxide, lithium hydroxide, sodium, potassium or ammonium salt of primary or tertiary phosphoric acid, sodium metasilicate, sodium carbonate, and ammonia; and organic alkali compounds such as monomethylamine, dimethylamine, trimethylamine, monoethylamine, diethylamine, triethylamine, monoisopropylamine, diisopropylamine, n-butylamine, di-n-butylamine, monoethaniolamine, diethanolamine, triethanolamine, ethyleneimine, and ethylenediamine.

The content of the alkali substance in the developing solution is preferably from 0.005 to 10% by weight, and particularly preferably from 0.05 to 5% by weight. If necessary, the developing solution can contain organic solvents; water-soluble sulfites such as potassium sulfite and sodium sulfite; aromatic hydroxy compounds such as alkali-soluble pyrazolone compound and alkali-soluble thiole compound; water softeners such as polyphosphate and aminopolycarboxylic acids; and various surfactants and various defoamers, such as sodium isopropylnaphthalene sulfonate and sodium n-butylnaplithalene sulfonate.

As the alkaline developing solution, a commercially available developing solution for negative-working PS plate or positive-working PS plate can be used. The heat-sensitive lithographic printing plate of the present invention can be developed by selecting the resin to be used even when using a commercially available developing solution of pH 13.5 to 14 used in a PS plate, or a more dilute developing solution of lower pH. The heat-sensitive lithographic printing plate capable of developing using a dilute developing solution of the pH lower than 9, is inferior in water resistance and the heat-sensitive layer is deteriorated during printing using dampening water, thereby reducing the printing resistance.

After forming a latent image by the above-mentioned method, the heat-sensitive lithographic printing plate of the present invention is developed by dipping in the above-mentioned developing solution to form a press plate. The temperature of the developing solution is preferably within a range from 15 to 40° C. and the dipping time is preferably within a range from one second to 2 minutes. If necessary, the surface can be rubbed slightly during the development.

After the development, the press plate is washed with water and an aqueous desensitizing agent is optionally applied thereon. Examples of the aqueous desensitizing agent include aqueous solutions of water-soluble natural polymers such as gum arabic, dextrin, and carboxymethyl cellulose; and water-soluble synthetic polymers such as polyvinyl alcohol, polyvinyl pyrrolidone, and polyacrylic acid. If necessary, acids and surfactants can be added. After applying the desensitizing agent, the heat-sensitive lithographic printing plate is dried to obtain a press plate.

These steps may be carried out separately, but are preferably carried out continuously using an image exposing apparatus or an autodeveloper. For example, the heat-sensitive lithographic printing plate of the present invention is mounted in an image exposing apparatus equipped with a laser such as a YAG laser or an infrared semiconductor laser as a light source, and then a heat-sensitive layer of the printing plate is directly irradiated with laser light based on digitized image information from a computer to form a latent image. Thereafter, the heat-sensitive layer is developed using an autodeveloper to obtain a press plate.

EXAMPLES

The present invention will be described in detail by way of examples. The non-volatile component, weight-average molecular weight, Tg, contact angle. nitrogen content and printing resistance were measured by the following procedures.

Measurement of Non-volatile Component

About 1 g of a sample was dried in a dryer at 130° C. for one hour and, after measuring weights of the sample before and after drying, the content of a non-volatile component in the sample was calculated.

Measurement of Weight-average Molecular Weight

Using an apparatus for the measurement of gel permeation chromatography "610 differential refractometer system" (hereinafter abbreviated as "GPC") manufactured by Waters Co., a weight-average molecular weight was measured and polystyrene standards were used as a reference to estimate the molecular weight.

Measurement of Tg

Using a differential scanning calorimetry "Shimadzu Heat Flux Differential Scanning Calorimetry DSC-50" (hereinafter abbreviated as "DSC") manufactured by Shimadzu Corporation, a sample was heated to 150° C. at a heating rate of 10° C./min, rapidly cooled to 0° C. or lower using liquid nitrogen and heated again to 150° C. at a heating rate of 10° C./min, and then the temperature at which an endothermic change starts was referred to as "Tg". As a control sample, alumina was used.

Measurement of Average Particle Diameter

Using a laser Doppler particle size distribution meter "Microtrack UPA-150" manufactured by Microtrack USA Co., an average particle diameter was measured.

Measurement of Contact Angle by the Wilhelmy Plate Method

After cutting a heat-sensitive lithographic printing plate into pieces of 10 cm squares, two pieces of the heat-sensitive lithographic printing plate was laminated using an adhesive so that a heat-sensitive layer faces outside, and the resulting laminate was cut into pieces of 2 cm squares to obtain specimens. Using an apparatus for automatic measurement of surface tension contact angle "K12" manufactured by Kruss Co. in Germany, the specimen was dipped in distilled water at 25° C. at a rate of 6 mm/min so that the surface to be measured is vertical to the liquid level and, after measuring an advancing contact angle, the specimen was drawn up at a rate of 6 mm/min and a receding contact angle was measured.

Measurement of Nitrogen Content

A heat-sensitive lithographic printing plate was cut into pieces in size of 0.5 cm×1 cm and burnt in an argon-oxygen gas flow at 800 to 900° C., and then the quantity of chemiluminescence generated when evolved nitrogen monoxide is oxidized with ozone to form nitrogen dioxide was measured by using a chemiluminescence detecting apparatus "TOX-100" manufactured by Mitsubishi Chemical Co. The content of nitrogen in the specimen was determined from the calibration curve obtained separately and the weight of the specimen of the heat-sensitive layer was determined by measuring weights of the specimen before and after burning, and then the nitrogen content of the heat-sensitive layer was calculated. Nitrogen measured herein originates in an alkali compound and an IR absorber in the heat-sensitive layer.

Production of Substrate having Hydrophilic Surface

The surface of an A2-sized aluminum plate having a thickness of 0.3 mm was polished with a nylon brush using an aqueous suspension of pumice stone and the surface was subjected to a graining treatment and was then anodized in a 20% sulfuric acid electrolytic solution at a current density of 2 A/dm$^2$ to form an oxide film of 2.7 g/m$^2$. The treated aluminum plate was washed with water and was then dried to obtain a substrate having a hydrophilic surface.

Method for Evaluation of Resolution

A tested heat-sensitive lithographic printing plate was mounted in a plate setter "Trend Setter 3244F" manufactured by Creo Co. and was then exposed to light via a predetermined pattern. After the development, the image was observed by a magnifier and a dot reproduction range was recorded. However, this evaluation method can be applied only to a heat-sensitive lithographic printing plate having a colored heat-sensitive layer.

Method for Evaluation of Printing Resistance by Accelerated Printing Resistance Test A tested press plate was mounted in a lithographic printing press "N-600 rotary press" manufactured by TOHAMA Co. and printing was carried out at a printing rate of 120,000 sheets/hour and a printing pressure of 0.25. A groundwood paper for newspapers manufactured by CHUETSU PULP & PAPER CO., LTD. was used as a paper for printing, black ink for newspaper "MKHS-EZ" manufactured by DAINIPPON INK AND CHEMICALS, INC. was used as ink, and an aqueous 2% solution of "FST-212" manufactured by DAINIPPON INK AND CHEMICALS, INC. was used as dampening water.

Synthesis Example 1 of Polymer

In a 1 liter four-necked flask equipped with a stirrer, a reflux condenser, a nitrogen introducing tube with a thermometer, and a dropping funnel, 300 g of propylene glycol monomethyl ether acetate (hereinafter abbreviated as "PGMEAc") was charged. After heating to 125° C. in a nitrogen atmosphere while stirring, a mixture of 230 g of styrene, 70 g of acrylic acid and 15 g of di-t-butyl peroxide was added dropwise over 3 hours. After the completion of dropwise addition, stirring was continued for 6 hours to obtain a PGMEAc solution of an alkali-soluble polymer having a non-volatile component of 50%, a weight-average molecular weight of 40,000, Tg of 125° C. and an acid value of 173 (hereinafter referred to as a "polymer (1)").

Synthesis Example 2 of Polymer

In a 1 liter four-necked flask equipped with a stirrer, a reflux condenser, a nitrogen introducing tube with a thermometer, and a dropping funnel, 300 g of PGMEAc was charged and, after heating to 125° C. in a nitrogen atmosphere while stirring, a mixture of 60 g of styrene, 147 g of methyl methacrylate, 66 g of butyl methacrylate, 27 g of acrylic acid and 15 g of di-t-butyl peroxide was added dropwise over 3 hours. After the completion of dropwise addition, stirring was continued for 6 hours to obtain a PGMEAc solution of an alkali-soluble polymer having a non-volatile component of 50%, a weight-average molecular weight of 35,000, Tg of 82° C. and an acid value of 67 (hereinafter referred to as "a polymer (2)").

Synthesis Example 3 of Polymer

The same operation as in the synthesis of the polymer (1) was carried out, except that 246 g of styrene and 54 g of acrylic acid were used in place of 230 g of styrene and 70 g of acrylic acid in the preparation of the polymer (1), a PGMEAc solution of an alkali-soluble polymer having a non-volatile component of 50%, a weight-average molecular weight of 35,000, Tg of 108° C. and an acid value of 133 (hereinafter referred to as a "polymer (3)") was obtained.

Synthesis Example 4 of Polymer

In a 1 liter four-necked flask equipped with a stirrer, a reflux condenser, a nitrogen introducing tube with a thermometer, and a dropping funnel, 300 g of PGMEAc was charged and, after heating to 125° C. while stirring, a mixture of 230 g of methyl methacrylate, 30 g of acrylic acid, 40 g of methacrylic acid and 15 g of di-t-butyl peroxide was added dropwise over 3 hours. After the completion of dropwise addition, stirring was continued for 6 hours to obtain a PGMEAc solution of an alkali-soluble polymer having a non-volatile component of 50%, a weight-average molecular weight of 35,000, Tg of 126° C. and an acid value of 157 (hereinafter referred to as a "polymer (4)").

Synthesis Example 5 of Polymer

In a 1 liter four-necked flask equipped with a stirrer, a reflux condenser, a nitrogen introducing tube with a thermometer, and a dropping funnel, 300 g of methyl ethyl ketone (hereinafter abbreviated as "MEK") was charged and, after heating to 80° C. while stirring, a mixture of 230 g of methyl methacrylate, 30 g of acrylic acid, 40 g of methacrylic acid and 12 g of t-butyl-peroxy-2-ethylhexanoate was added dropwise over 3 hours. After 6 hours from dropwise addition, 1.5 g of t-butyl-peroxy-2-ethylhexanoate was added. After 4 hours, 1.5 g of t-butyl-peroxy-2-ethylhexanoate was added and stirring was continued for 4 hours to obtain a MEK solution of an alkali-soluble polymer having a non-volatile component of 50%, a weight-average molecular weight of 20,000, Tg of 115° C. and an acid value of 157 (hereinafter referred to as a "polymer (5)").

Synthesis Example 6 of Polymer

The same operation as in the synthesis of the polymer (1) was carried out, except that 260 g of styrene and 40 g of acrylic acid were used in place of 230 g of styrene and 70 g of acrylic acid in the preparation of the polymer (1), a PGMEAc solution of an alkali-soluble polymer having a non-volatile component of 50%, a weight-average molecular weight of 35,000, Tg of 104° C. and an acid value of 99 (hereinafter referred to as a "polymer (6)") was obtained.

Synthesis Example 7 of Polymer

In a 1 liter four-necked flask equipped with a stirrer, a reflux condenser, a nitrogen introducing tube with a thermometer, and two dropping funnels, 150 g of distilled water, 0.22 g of methyl methacrylate, and 0.44 g of an emulsifier "NEWCOL560SF" manufactured by Nippon Nyukazai Co., Ltd. were charged and after heating to 80° C. while stirring in a nitrogen atmosphere, 0.44 g of methyl methacrylate was added and stirring was continued for 15 minutes. Then, a solution prepared by dissolving 0.15 g of ammonium persulfate in 5 g of distilled water was added and stirring was continued for 15 minutes. Then, a solution prepared by dissolving 22 g of methyl methacrylate, 1 g of an emulsifier "NEWCOL560SF" and 0.15 g of ammonium persulfate in 50 g of distilled water was added dropwise over 2 hours. After the completion of dropwise addition, stirring was continued for 3 hours to obtain a water dispersion of polymethyl methacrylate particles having a non-volatile component of 50%, Tg of 100° C. and an average particle diameter of 100 nm.

Preparation of Heat-Sensitive Composition (A)

In a 500 ml four-necked flask equipped with a stirrer and an apparatus for distilling off a solvent, 300 g of the PGMEAc solution of the polymer (1) obtained in Synthesis Example 1 of polymer was charged and heated to 200° C. in a nitrogen atmosphere under normal pressure while stirring. Then, PGMEAc was distilled off while gradually evacuating. At the time when the pressure was reduced to 0.03 MPa and the distilling off of the solvent was completed, the pressure was returned to normal pressure. The copolymer in a molten state was cooled and ground to obtain a solid matter of the polymer (1). In a 500 ml four-necked flask equipped with a stirrer, a reflux condenser, and a nitrogen introducing tube with a thermometer, 50 g of the solid matter of the polymer (1), 10 g of 25% ammonia water and 218 g of water were charged and stirred while maintaining at 90° C. to obtain an aqueous 18% solution of an ammonium salt of the polymer (1) (hereinafter referred to as a heat-sensitive composition (A)).

Preparation of Heat-Sensitive Composition (B)

To 20 g of the heat-sensitive composition (A), a solution prepared by dissolving 280 mg of 4-methylbenzenesulfonic acid 2-(2-(2-chloro-3-((1,3-dihydro-1,1,3-trimethyl-2H-benz(e)indol-2-ylidene)ethylidene)-1-cyclohexen-1-yl)ethenyl)-1,3-trimethyl-1H-benz(e)indolium as an IR absorber and 40 mg of Crystal Violet as a colorant in a mixed solvent of 4 g of ethanol and 1 g of 2-methoxyethanol while stirring to obtain a heat-sensitive composition (B).

Preparation of Heat-Sensitive Composition (C)

The same operation as in the preparation of the heat-sensitive composition (A) was carried out, except that 13 g of methylethanolamine and 215 g of water were used in place of 10 g of 25% ammonia water and 218 g of water in the preparation of the heat-sensitive composition (A), an aqueous 18% solution of a dimethylethanolamine salt of the polymer (1) was obtained. Using 20 g of the aqueous solution, the same operation as in the preparation of the heat-sensitive composition (B) was carried out to obtain a heat-sensitive composition (C).

Preparation of Heat-Sensitive Composition (D)

In a 500 ml four-necked flask equipped with a stirrer and an apparatus for distilling off a solvent, 300 g of the PGMEAc solution of the polymer (2) obtained in Synthesis Example 2 of polymer was charged and heated to 200° C. in a nitrogen atmosphere under normal pressure while stirring. Then, PGMEAc was distilled off while gradually evacuating. At the time when the pressure was reduced to 0.03 MPa and the distilling off of the solvent was completed, the pressure was returned to normal pressure. The copolymer in a molten state was cooled and ground to obtain a solid matter of the polymer (2).

In a 500 ml four-necked flask equipped with a stirrer, a reflux condenser, and a nitrogen introducing tube with a thermometer, 50 g of the solid matter of the polymer (2), 4 g of 25% ammonia water and 224 g of water were charged and stirred while maintaining at 90° C. to obtain an aqueous 18% solution of an ammonium salt of the polymer (2). To 20 g of the aqueous solution, 0.3 g of an IR absorber "YKR-3070" manufactured by Yamamoto Chemicals Inc., 40 mg of Crystal Violet, 4 g of ethanol and 1 g of 2-methoxy ethanol were added, and then the mixture was subjected to a dispersion treatment using an ultrasonic disperser for 5 minutes to obtain a heat-sensitive composition (D).

Preparation of Heat-Sensitive Composition (E)

The same operation as in the preparation of the heat-sensitive composition (A) was carried out, except that 7.5 g of 25% ammonia water and 220 g of water were used in place of 10 g of 25% ammonia water and 218 g of water in the preparation of the heat-sensitive composition (A), an aqueous 18% solution of an ammonium salt of the polymer (1) was obtained. Using 20 g of the aqueous solution, the same operation as in the preparation of the heat-sensitive composition (D) was carried out to obtain a heat-sensitive composition (E).

Preparation of Heat-Sensitive Composition (F)

The same operation as in the preparation of the heat-sensitive composition (A) was carried out, except that 300 g of the PGMWAc solution of the polymer (3) was used in place of 300 g of the PGMWAc solution of the polymer (1) and 8.5 g of 25% ammonia water and 220 g of water were used in place of 10 g of 25% ammonia water and 218 g of water in the preparation of the heat-sensitive composition (A), an aqueous 18% solution of an ammonium salt of the polymer (3) was obtained. Using 20 g of the aqueous solution, the same operation as in the preparation of the heat-sensitive composition (D) was carried out to obtain a heat-sensitive composition (F).

Preparation of Heat-Sensitive Composition (G)

The same operation as in the preparation of the heat-sensitive composition (A) was carried out, except that 300 g of the PGMWAc solution of the polymer (4) was used in place of 300 g of the PGMWAc solution of the polymer (1) in the preparation of the heat-sensitive composition (A), an aqueous 18% solution of an ammonium salt of the polymer (4) was obtained. Using 20 g of the aqueous solution, the same operation as in the preparation of the heat-sensitive composition (D) was carried out to obtain a heat-sensitive composition (G).

Preparation of Heat-Sensitive Composition (H) for Comparative Example

To 8 g of the PGMEAc solution of the polymer (1) obtained in Synthesis Example 1 of polymer, 19 g of PGMEAc was added to obtain a heat-sensitive composition (H).

Preparation of Heat-Sensitive Composition (1) for Comparative Example

In a 500 ml four-necked flask equipped with a stirrer, a reflux condenser, a nitrogen introducing tube with a thermometer, and a dropping funnel 100 g of the solid matter of the polymer (1) obtained in the preparation of the heat-sensitive composition (A) and 100 g of MEK were added and stirred at 80° C. for 2 hours to obtain a MEK solution of the polymer (1). To 100 g of the solution, 10 g of 5% ammonia water was added and, after slowly adding 500 g of water while stirring, the solution was subjected to phase inversion emulsification to obtain a water dispersion element containing MEK. Excess water was distilled off while evacuating to obtain a water dispersion having an average particle diameter of 200 nm and a dry solid content of 18%. To 20 g of the water dispersion, 0.3 g of an IR absorber "YKR-3070" manufactured by Yamamoto Chemicals Inc. and 5 g of ethanol were added and, after shaking together with 180 g of zirconia beads having a particle size of 1 mm for one hour using a paint conditioner, zirconia beads were removed by filtration to obtain a heat-sensitive composition (1).

Preparation of Heat-Sensitive Composition (J) for Comparative Example

To 100 g of the MEK solution of the polymer (5) obtained in Synthesis Example 5 of polymer, 7 g of 5% ammonia water was added and, after slowly adding 500 g of water while stirring, the solution was subjected to phase inversion emulsification to obtain a water dispersion element of the polymer (5) containing MEK. MEK and excess water were distilled off while evacuating to obtain a water dispersion of the polymer (5) of the polymer (5) having an average particle diameter of 200 nm and a dry solid content of 18%. To 20 g of the water dispersion, 0.3 g of an IR absorber "YKR-3070" manufactured by Yamamoto Chemicals Inc. and 5 g of ethanol were added and, after shaking together with 180 g of zirconia beads having a particle size of 1 mm for one hour using a paint conditioner, zirconia beads were removed by filtration to obtain a heat-sensitive composition (J).

Preparation of Heat-Sensitive Composition (K) for Comparative Example 20 g of polyacrylic acid having an average molecular weight of 5,000 manufactured by Wako Pure Chemicals Industries, Ltd. was dissolved in 80 g of water to obtain a heat-sensitive composition (K).

Preparation of Heat-Sensitive Composition (L) for Comparative Example

To 11.25 g of the water dispersion of polymethyl methacrylate particles obtained in Synthesis Example 7 of polymer, 5.83 g of a 15% water dispersion of carbon black "BONJET BLACK CW-1" manufactured by Orient Chemical Industry Ltd., 7.9 g of distilled water and 25 g of an aqueous 2% solution of polyvinyl alcohol having a saponification degree of 98% were added while stirring to obtain a heat-sensitive composition (L) containing 5% of a non-volatile component.

Preparation of Heat-Sensitive Composition (M) for Comparative Example

The same operation as in the preparation of the heat-sensitive composition (A) was carried out, except that a polymer (6) was used in place of the polymer (1) and 6.5 g of 25% ammonia water and 221 g of water were used in place of 10 g of 25% ammonia water and 218 g of water in the preparation of the heat-sensitive composition (A), an aqueous 18% solution of an ammonium salt of the polymer (6) was obtained. Using 20 g of the aqueous solution, the same operation as in the preparation of the heat-sensitive composition (D) was carried out to obtain a heat-sensitive composition (M).

Example 1

A heat-sensitive composition (A) was applied on a substrate using a #8 bar coater and was then dried at 60° C. for 4 minutes to obtain two heat-sensitive lithographic printing plates (A-1) each having a 2 μm thick heat-sensitive layer. The nitrogen content of the heat-sensitive layer was 0.86%.

After one heat-sensitive lithographic printing plate (A-1) was cut in half, a contact angle of one piece was measured as it is, while a contact angle of another piece was measured after heating at 150° C. for 3 minutes and cooling. An advancing contact angle ($\theta^{f1}$) before heating was 88.2° and a receding contact angle ($\theta^{b1}$) was 39.8°, while a receding contact angle ($\theta^{b2}$) after heating was 55.3° which was larger than the receding contact angle ($\theta^{b1}$) before heating. A difference in receding contact angle before and after heating, ($\theta^{b2}-\theta^{b1}$), was 15.5°.

After another heat-sensitive lithographic printing plate (A-1) was cut in half, one piece was heated to 120° C. for one hour. The nitrogen content of the heat-sensitive layer after heating was 0.45%. The heat-sensitive lithographic printing plate (A-1) after heating was dipped in a 1:99 water-diluted solution of (pH 12.3) of a developing solution for positive PS plate "PD-1" manufactured by Kodak Polychrome Graphics (hereinafter referred to as a "developing solution") at 30° C. for 25 seconds. As a result, the heat-sensitive layer did not swell nor peel. Another heat-sensitive lithographic printing plate (A-1) was dipped in a 1:99 water-diluted solution of the developing solution at 30° C. for 25 seconds. As a result, the entire heat-sensitive layer was dissolved. These results show that the heat-sensitive layer of the heat-sensitive lithographic printing plate (A-1) is made to be insoluble in the 1:99 water-diluted solution of the developing Solution by heating at 120° C. for one minute.

Using the heat-sensitive lithographic printing plate (A-1) dipped in the 1:99 water-diluted solution of the developing solution after heating as a press plate, an accelerated printing resistance test (20,000 sheets) was carried out. As a result, no abnormality was observed in the resulting print and press plate.

Example 2

The same operation as in Example 1 was carried out, except that standing in a vacuum dryer under vacuum degree of 20 Pa for 24 hours was carried out in place of drying at 60° C. for 4 minutes in Example 1, two heat-sensitive lithographic printing plates (A-2) were obtained. The nitrogen content of the heat-sensitive layer was 0.46%.

After one heat-sensitive lithographic printing plate (A-2) was cut in half, the contact angle was measured in the same manner as in Example 1. As a result, an advancing contact angle ($\theta^{f1}$) before heating was 89.0° and a receding contact angle ($\theta^{b1}$) was 40.5°0, while a receding contact angle ($\theta^{b2}$) after heating was 55.6° which was larger than the receding contact angle ($\theta^{b1}$) before heating. A difference in receding contact angle before and after heating, ($\theta^{b2}-\theta^{b1}$), was 15.1°.

After another heat-sensitive lithographic printing plate (A-2) was cut in half, one piece was heated to 120° C. for one hour. The nitrogen content of the heat-sensitive layer after heating was 0.45% and was almost the same as that before heating. The heat-sensitive lithographic printing plate (A-2) after heating was dipped in a 1:99 water-diluted solution of a developing solution at 30° C. for 25 seconds. As a result, the heat-sensitive layer did not swell nor peel. Another heat-sensitive lithographic printing plate (A-2) was dipped in a 1:99 water-diluted solution of the developing solution at 30° C. for 25 seconds. As a result, the entire heat-sensitive layer was dissolved. These results show that the heat-sensitive layer of the heat-sensitive lithographic printing plate (A-2) is made to be insoluble in the developing solution by heating even if the nitrogen content in the heat-sensitive layer does not change.

Using the heat-sensitive lithographic printing plate (A-2) dipped in the 1:99 water-diluted solution of the developing solution after heating as a press plate, an accelerated printing resistance test (20,000 sheets) was carried out. As a result, no abnormality was observed in the resulting print and press plate.

Example 3

A heat-sensitive composition (B) was applied on a substrate using a #9 bar coater and was then dried at 60° C. for 4 minutes to obtain two heat-sensitive lithographic printing plates (B-1) each having a 2 μm thick heat-sensitive layer.

After one heat-sensitive lithographic printing plate (B-1) was cut in half, a contact angle of one piece was measured as it is, while a contact angle of another piece was measured after heating at 150° C. for 3 minutes and cooling. An advancing contact angle ($\theta^{f1}$) before heating was 93.4° and a receding contact angle ($\theta^{b1}$) was 25.1°, while a receding contact angle ($\theta^{b2}$) after heating was 44.2° which was larger than the receding contact angle ($\theta^{b1}$) before heating. A difference in receding contact angle before and after heating, ($\theta^{b2}-\theta^{b1}$), was 19.1°.

Another heat-sensitive lithographic printing plate (B-1) was irradiated with laser light at a dose of 180 mJ/cm$^2$ using an exposer "Trend Setter 3244F" equipped with near infrared semiconductor laser manufactured by Creo Co. under the conditions of a power of 7.2 W and 150 rpm to form a latent image. The heat-sensitive lithographic printing plate was developed by dipping in a 1:99 water-diluted solution of a developing solution at 30° C. for 25 seconds, washed with water and then dried to obtain a press plate. The resulting press plate had a resolution of 1 to 99%. The press plate was subjected to an accelerated printing resistance test (20,000 sheets). As a result, no abnormality was observed in the resulting print and press plate.

Example 4

A heat-sensitive composition (C) was applied on a substrate using, a #9 bar coater and was then dried at 60° C. for 4 minutes to obtain two heat-sensitive lithographic printing plates (C-1) each having a 2 μm thick heat-sensitive layer.

After one heat-sensitive lithographic printing plate (C-1) was cut in half, a contact angle of one piece was measured as it is, while a contact angle of another piece was measured after heating at 150° C. for 3 minutes and cooling. An advancing contact angle ($\theta^{f1}$) before heating was 84.5° and a receding contact angle ($\theta^{b1}$) was 7.8°, while a receding contact angle ($\theta^{b2}$) after heating was 33.7° which was larger than the receding contact angle ($\theta^{b1}$) before heating. A difference in receding contact angle before and after heating, ($\theta^{b2}-\theta^{b1}$), was 25.9°.

Using another heat-sensitive lithographic printing plate (C-1), a press plate was obtained in the same manner as in Example 3. The resulting press plate had a resolution of 2 to 98%. The nitrogen content of the non-image area of the press plate was 1.65% and was almost the same as the nitrogen content (1.64%) of the image area. The press plate was subjected to an accelerated printing resistance test (20.000 sheets). As a result, no abnormality was observed in the resulting print and press plate.

Example 5

A heat-sensitive composition (D) was applied on a substrate using a #9 bar coater and was then dried at 60° C. for 4 minutes to obtain two heat-sensitive lithographic printing plates (D-1) each having a 2 μm thick heat-sensitive layer.

After one heat-sensitive lithographic printing plate (D-1) was cut in half, a contact angle of one piece was measured as it is, while a contact angle of another piece was measured after heating at 150° C. for 3 minutes and cooling. An advancing contact angle ($\theta^{f1}$) before heating was 88.1° and a receding contact angle ($\theta^{b1}$) was 23.1°, while a receding contact angle ($\theta^{b2}$) after heating was 51.9° which was larger than the receding contact angle ($\theta^{b1}$) before heating. A difference in receding contact angle before and after heating, ($\theta^{b2}-\theta^{b1}$), was 28.8°.

Using another heat-sensitive lithographic printing plate (D-1), a latent image was formed in the same manner as in Example 3. The heat-sensitive lithographic printing plate was developed by dipping in a 1:8 water-diluted solution (pH 13.6) of a developing solution at 30° C. for 25 seconds, washed with water and then dried to obtain a press plate. The resulting press plate had a resolution of 2 to 98%. The press plate was subjected to an accelerated printing resistance test (20,000 sheets). As a result, no abnormality was observed in the resulting print and press plate.

Example 6

A heat-sensitive composition (E) was applied on a substrate using a #9 bar coater and was then dried at 60° C. for 4 minutes to obtain two heat-sensitive lithographic printing plates (E-1) each having a 2 μm thick heat-sensitive layer.

After one heat-sensitive lithographic printing plate (E-1) was cut in half, a contact angle of one piece was measured as it is, while a contact angle of another piece was measured after heating at 150° C. for 3 minutes and cooling. An advancing contact angle ($\theta^{f1}$) before heating was 101.0° and a receding contact angle ($\theta^{b1}$) was 20.9°, while a receding contact angle ($\theta^{b2}$) after heating was 43.6° which was larger than the receding contact angle ($\theta^{b1}$) before heating. A difference in receding contact angle before and after heating, ($\theta^{b2}-\theta^{b1}$), was 22.7°.

Using another heat-sensitive lithographic printing plate (E-1), a press plate was obtained in the same manner as in Example 3. The resulting press plate had a resolution of 2 to 98%. The press plate was subjected to an accelerated printing resistance test (20,000 sheets). As a result, no abnormality was observed in the resulting print and press plate.

Example 7

A heat-sensitive composition (F) was applied on a substrate using a #9 bar coater and was then dried at 60° C. for 4 minutes to obtain two heat-sensitive lithographic printing plates (F-1) each having a 2 μm thick heat-sensitive layer.

After one heat-sensitive lithographic printing plate (F-1) was cut in half, a contact angle of one piece was measured as it is, while a contact angle of another piece was measured after heating at 150° C. for 3 minutes and cooling. An advancing contact angle ($\theta^{f1}$) before heating was 106.8° and a receding contact angle ($\theta^{b1}$) was 26.6°. while a receding contact angle ($\theta^{b2}$) after heating was 58.0° which was larger than the receding contact angle ($\theta^{b1}$) before heating. A difference in receding contact angle before and after heating, ($\theta^{b2}-\theta^{b1}$), was 31.4°.

Using another heat-sensitive lithographic printing plate (F-1), a latent image was formed in the same manner as in Example 3. The heat-sensitive lithographic printing plate was developed by dipping in a 1:49 water-diluted solution (pH 13.1) of a developing solution at 30° C. for 25 seconds, washed with water and then dried to obtain a press plate. The resulting press plate had a resolution of 1 to 98%. The press plate was subjected to an accelerated printing resistance test (20,000 sheets). As a result, no abnormality was observed in the resulting press plate, although slight scratches were observed in the resulting press plate after printing 15,000 sheets.

Example 8

A heat-sensitive composition (G) was applied on a substrate using a #9 bar coater and was then dried at 60° C. for 4 minutes to obtain two heat-sensitive lithographic printing plates (G-1) each having a 2 μm thick heat-sensitive layer.

After one heat-sensitive lithographic printing plate (G-1) was cut in half, a contact angle of one piece was measured as it is, while a contact angle of another piece was measured after heating at 150° C. for 3 minutes and cooling. An advancing contact angle ($\theta^{f1}$) before heating was 76.9° and a receding contact angle ($\theta^{b1}$) was 42.7°, while a receding contact angle ($\theta^{b2}$) after heating was 45.4° which was larger than the receding contact angle ($\theta^{b1}$) before heating. A difference in receding contact angle before and after heating, ($\theta^{b2}-\theta^{b1}$), was 2.7°.

Using another heat-sensitive lithographic printing plate (G-1) a latent image was formed in the same manner as in Example 3. The heat-sensitive lithographic printing plate was developed by dipping in a 1:99 water-diluted solution (pH 11.9) of a developing solution at 30° C. for 25 seconds, washed with water and then dried to obtain a press plate. The resulting press plate had a resolution of 2 to 98%. The press plate was subjected to an accelerated printing resistance test (20,000 sheets). As a result, no abnormality was observed in the resulting press plate, although slight scratches were observed in the resulting press plate after printing 15,000 sheets.

Comparative Example 1

A heat-sensitive composition (H) was applied on a substrate using a #8 bar coater and was then dried at 60° C. for 4 minutes to obtain two heat-sensitive lithographic printing plates (H-1) each having a 2 μm thick heat-sensitive layer.

After one heat-sensitive lithographic printing plate (H-1) was cut in half, a contact angle of one piece was measured as it is, while a contact angle of another piece was measured after heating at 150° C. for 3 minutes and cooling. An advancing contact angle ($\theta^{f1}$) before heating was 91.7° and a receding contact angle ($\theta^{b1}$) was 49.7°, while a receding contact angle ($\theta^{b2}$) after heating was 49.5° which was larger than the receding contact angle ($\theta^{b1}$) before heating. A difference in receding contact angle before and after heating, ($\theta^{b2}-\theta^{b1}$), was 0.2°.

Heat-sensitive lithographic printing plates (H-1) before and after heating were dipped in a 1:99 water-diluted solution of a developing solution at 30° C. for 25 seconds. As a result, the heat-sensitive layer did not swell nor peel. These results show that the heat-sensitive layer of the heat-sensitive lithographic printing plate (H-1) cannot be developed with the developing solution and no image can be formed.

Comparative Example 2

A heat-sensitive composition (I) was applied on a substrate using a #9 bar coater and was then dried at 60° C. for 4 minutes to obtain two heat-sensitive lithographic printing plates (I-1) each having a 2 μm thick heat-sensitive layer.

After one heat-sensitive lithographic printing plate (I-1) was Cut in half, a contact angle of one piece was measured as it is, while a contact angle of another piece was measured after heating at 150° C. for 3 minutes and cooling. An advancing contact angle ($\theta^{f1}$) before heating was 116° and a receding contact angle ($\theta^{b1}$) was 18.7°, while a receding contact angle ($\theta^{b2}$) after heating was 18.0° which was larger than the receding contact angle ($\theta^{b1}$) before heating. A difference in receding contact angle before and after heating, ($\theta^{b2}-\theta^{b1}$), was 0.7°.

Using another heat-sensitive lithographic printing plate (I-1), a press plate was obtained in the same manner as in Example 3. The resulting press plate had a resolution of 2 to 98%. The press plate wits subjected to an accelerated printing resistance test. As a result, severe image defects were observed on the surface of the heat-sensitive layer after the printing test (3,000 sheets).

Comparative Example 3

A heat-sensitive composition (J) was applied on a substrate using a #9 bar coater and was then dried at 60° C. for 4 minutes to obtain two heat-sensitive lithographic printing plates (J-1) each having a 2 μm thick heat-sensitive layer.

After one heat-sensitive lithographic printing plate (J-1) was cut in half, a contact angle of one piece was measured as it is, while a contact angle of another piece was measured after heating at 150° C. for 3 minutes and cooling. An advancing contact angle ($\theta^{f1}$) before heating was 68.8° and a receding contact angle ($\theta^{b1}$) was 7.4°, while a receding contact angle ($\theta^{b2}$) after heating was 12.5° which was larger than the receding contact angle ($\theta^{b1}$) before heating. A difference in receding contact angle before and after heating, ($\theta^{b2}-\theta^{b1}$), was 5.1°.

Using another heat-sensitive lithographic printing plate (J-1), a press plate was obtained in the same manner as in Example 3. The resulting press plate had a resolution of 5 to 98%. The press plate was subjected to an accelerated printing resistance test. As a result, severe image defects were observed on the surface of the heat-sensitive layer after the printing test (5,000 sheets).

Comparative Example 4

A heat-sensitive composition (K) was applied on a substrate using a #8 bar coater and was then dried at 60° C. for 4 minutes to obtain two heat-sensitive lithographic printing plates (K-1) each having a 2 μm thick heat-sensitive layer.

After one heat-sensitive lithographic printing plate (K-1) was cut in half, a contact angle of one piece was measured as it is, while a contact angle of another piece was measured after heating at 150° C. for 3 minutes and cooling. An advancing contact angle ($\theta^{f1}$) before heating was 14.7° and a receding contact angle ($\theta^{b1}$) was 6.2°. while a receding contact angle ($\theta^{b2}$) after heating was 6.5°which was larger than the receding contact angle ($\theta^{b1}$) before heating. A difference in receding contact angle before and after heating, ($\theta^{b2}-\theta^{b1}$) was 0.3°.

After another heat-sensitive lithographic printing plate (K-1) was cut in half, one piece was not heated, while another piece was heated to 150° for 3 minutes. The non-heated heat-sensitive lithographic printing plate and the heated heat-sensitive lithographic printing plate were clipped in a 1:99 water-diluted solution of a developing solution at 30° C. for 25 seconds. As a result, the entire heat-sensitive layer was dissolved. These results show that the heat-sensitive layer of the heat-sensitive lithographic printing plate (K-1) cannot form an image by heating.

Comparative Example 5

A heat-sensitive composition (L) was applied on a substrate using a #20 bar coater and was then dried at 60° C. for 4 minutes to obtain two heat-sensitive lithographic printing plates (L-1) each having a 2 μm thick heat-sensitive layer.

After one heat-sensitive lithographic printing plate (L-1) was cut in half, a contact angle of one piece was measured as it is, while a contact angle of another piece was measured after heating at 150° C. for 3 minutes and cooling. An advancing contact angle ($\theta^{f1}$) before heating was 77.6° and a receding contact angle ($\theta^{b1}$) was 22.2°, while a receding contact angle ($\theta^{b2}$) after heating was 22.3° which was larger than the receding contact angle ($\theta^{b1}$) before heating. A difference in receding contact angle before and after heating, ($\theta^{b2}-\theta^{b1}$), was 0.1°.

Using another heat-sensitive lithographic printing plate (L-1), a press plate was obtained in the same manner as in Example 2. The press plate was subjected to an accelerated printing resistance test. As a result, severe image defects were observed on the surface of the heat-sensitive layer after the printing test (3,000 sheets).

Comparative Example 6

A heat-sensitive composition (M) was applied on a substrate using a #20 bar coater and was then dried at 60° C. for 4 minutes to obtain two heat-sensitive lithographic printing plates (M-1) each having a 2 μm thick heat-sensitive layer.

After one heat-sensitive lithographic printing plate (M-1) was cut in half, a contact angle of one piece was measured as it is, while a contact angle of another piece was measured after heating at 150° C. for 3 minutes and cooling. An advancing contact angle ($\theta^{f1}$) before heating was 117.9° and a receding contact angle ($\theta^{b1}$) was 29.7°, while a receding contact angle ($\theta^{b2}$) after heating was 63.2° which was larger than the receding contact angle ($\theta^{b1}$) before heating. A difference in receding contact angle before and after heating, ($\theta^{b2}-\theta^{b1}$), was 33.5°.

Using another heat-sensitive lithographic printing plate (M-1), a latent image was formed in the same manner as in Example 3. The heat-sensitive lithographic printing plate was developed by dipping in a 1:49 water-diluted solution (pH 13.1) of a developing solution at 30° C. for 40 seconds, washed with water and then dried to obtain a press plate. The resulting press plate had a resolution of 2 to 95%. The press plate was subjected to an accelerated printing resistance test. As a result, image defects were observed on the surface of the heat-sensitive layer after the printing test (3,000 sheets).

TABLE 1

| | Polymer | | | | | Solid |
|---|---|---|---|---|---|---|
| | Type | Mw | Tg | Acid value | Neutralization ratio | content of composition |
| Example 1 | Styrene-acrylic acid copolymer | 40,000 | 125 | 173 | 95% | 18% |
| Example 2 | Styrene-acrylic acid copolymer | 40,000 | 125 | 173 | 95% | 18% |
| Example 3 | Styrene-acrylic acid copolymer | 40,000 | 125 | 173 | 95% | 18% |

TABLE 1-continued

| | | | | | | |
|---|---|---|---|---|---|---|
| Example 4 | Styrene-acrylic acid copolymer | 40,000 | 125 | 173 | 73% | 15% |
| Example 5 | Styrene-acrylic acid copolymer | 35,000 | 82 | 67 | 98% | 16% |
| Example 6 | Styrene-acrylic acid copolymer | 40,000 | 125 | 173 | 71% | 16% |
| Example 7 | Styrene-acrylic acid copolymer | 35,000 | 108 | 133 | 100% | 16% |
| Example 8 | Methyl methacrylate-(meth)acrylic acid copolymer | 35,000 | 126 | 157 | 89% | 16% |
| Comparative Example 1 | Styrene-acrylic acid copolymer | 40,000 | 125 | 173 | 0% | 15% |
| Comparative Example 2 | Styrene-acrylic acid copolymer | 40,000 | 125 | 173 | 19% | 15% |
| Comparative Example 3 | Methyl methacrylate-(meth)acrylic acid copolymer | 20,000 | 115 | 157 | 15% | 15% |
| Comparative Example 4 | Polyacrylic acid | 5,000 | — | 779 | 0% | 20% |
| Comparative Example 5 | Polymethacrylic acid<br>Polyvinyl alcohol | —<br>— | 100<br>— | 652<br>— | 0% | 5% |
| Comparative Example 6 | Styrene-acrylic acid copolymer | 35,000 | 104 | 99 | 100% | 15% |

| | Before heating | | | | |
|---|---|---|---|---|---|
| | Advancing contact angle | Receding contact angle | After heating Receding contact angle | Difference in receding contact angle | Developability/Resolution Printing resistance |
| Example 1 | 88.2 | 39.8 | 55.3 | 15.5 | good developability 20,000 sheets |
| Example 2 | 89.0 | 40.5 | 55.6 | 15.1 | good developability 20,000 sheets |
| Example 3 | 93.1 | 25.1 | 44.2 | 19.1 | resolution of 1 to 99% 20,000 sheets |
| Example 4 | 84.5 | 7.8 | 33.7 | 25.9 | resolution of 1 to 99% 20,000 sheets |
| Example 5 | 88.1 | 23.1 | 51.9 | 28.8 | resolution of 2 to 98% 20,000 sheets |
| Example 6 | 101.0 | 20.9 | 43.6 | 22.7 | resolution of 2 to 98% 20,000 sheets |
| Example 7 | 106.8 | 26.6 | 58.0 | 31.4 | resolution of 1 to 99% 15,000 sheets |
| Example 8 | 76.9 | 42.7 | 45.4 | 2.7 | resolution of 2 to 98% 15,000 sheets |
| Comparative Example 1 | 91.7 | 49.7 | 49.5 | −0.2 | peeling occurred — |
| Comparative Example 2 | 116.0 | 18.7 | 18.0 | −0.7 | resolution of 2 to 98% 3,000 sheets |
| Comparative Example 3 | 68.8 | 7.4 | 12.5 | 5.1 | resolution of 5 to 98% 5,000 sheets |
| Comparative Example 4 | 14.7 | 6.2 | 6.5 | 0.3 | peeling occurred — |
| Comparative Example 5 | 77.6 | 22.2 | 22.3 | 0.1 | — 3,000 sheets |
| Comparative Example 6 | 117.9 | 29.7 | 63.2 | 33.5 | resolution of 2 to 95% 3,000 sheets |

What is claimed is:

1. A heat-sensitive lithographic printing plate comprising a substrate having a hydrophilic surface and a heat-sensitive layer made of an alkali-soluble polymer formed on the surface of the substrate, wherein an advancing contact angle ($\theta^{f1}$) of the surface of the heat-sensitive layer with water at 25° C. is within a range from 70° to 110°, a receding contact angle ($\theta^{b2}$) of the surface of the heat-sensitive layer with water at 25° C. after heating at 150° C. for 3 minutes is larger than a receding contact angle ($\theta^{b1}$) of the surface of the heat-sensitive layer with water at 25° C. before heating, and a difference in receding contact angle before and after heating, ($\theta^{b2}-\theta^{b1}$), is larger than 1° and is smaller than 40°.

2. The heat-sensitive lithographic printing plate according to claim 1, wherein the receding contact angle ($\theta^{b1}$) is within a range from 5° to 50° and the receding contact angle ($\theta^{b2}$) is within a range from 30° to 60°.

3. The heat-sensitive lithographic printing plate according to claim 1, wherein the alkali-soluble polymer is a copolymer of a monomer having a carboxyl group and a hydrophobic monomer, and the heat-sensitive layer is formed by applying a heat-sensitive composition, which is prepared by dissolving the copolymer in an aqueous alkaline solution, on the surface of the substrate and drying the heat-sensitive composition.

4. The heat-sensitive lithographic printing plate according to claim 3, wherein the alkali-soluble polymer has an acid value of 40 to 500 and a weight-average molecular weight of 5,000 to 200,000.

5. The heat-sensitive lithographic printing plate according to claim 3, wherein the monomer having a carboxyl group is acrylic acid or methacrylic acid, and the hydrophobic monomer is at least one type of a monomer selected from the group consisting of styrene, styrene derivatives and methyl methacrylate.

6. The heat-sensitive lithographic printing plate according to claim 3, wherein the monomer having a carboxyl group is acrylic acid, the hydrophobic monomer is styrene, and a weight ratio of acrylic acid to styrene is within a range from 40:60 to 15:85.

7. The heat-sensitive lithographic printing plate according to claim 3, wherein the monomer having a carboxyl group is acrylic acid, the hydrophobic monomer is methyl methacrylate, and a weight ratio of acrylic acid to methyl methacrylate is within a range from 14:86 to 5:95.

8. An image forming method, which comprises forming a latent image on a heat-sensitive layer of the heat-sensitive lithographic printing plate of claim 1 using heat generated upon irradiation with laser light, and developing the heat-sensitive layer using an alkaline developing solution of pH 9 to 14.

* * * * *